US008186389B2

(12) United States Patent
Hodges et al.

(10) Patent No.: US 8,186,389 B2
(45) Date of Patent: May 29, 2012

(54) YARN TUFT TRANSFER SYSTEM

(75) Inventors: Bruce Peter Hodges, Kidderminster (GB); Michael Winspear Burton, Stourbridge (GB)

(73) Assignee: Brintons Limited, Worcestershire (GB)

( * ) Notice: Subject to any disclaimer, the term of this patent is extended or adjusted under 35 U.S.C. 154(b) by 240 days.

(21) Appl. No.: 12/596,904

(22) PCT Filed: Apr. 22, 2008

(86) PCT No.: PCT/GB2008/001435

§ 371 (c)(1),
(2), (4) Date: Apr. 5, 2010

(87) PCT Pub. No.: WO2008/129304

PCT Pub. Date: Oct. 30, 2008

(65) Prior Publication Data

US 2010/0200103 A1 Aug. 12, 2010

(30) Foreign Application Priority Data

Apr. 23, 2007 (GB) ..... 0707802.5

(51) Int. Cl.
*D03D 39/20* (2006.01)
*D03D 39/00* (2006.01)
*D03D 31/00* (2006.01)

(52) U.S. Cl. ..... 139/7 B; 139/7 A; 139/7 F; 139/7 D; 139/7 R

(58) Field of Classification Search ..... None
See application file for complete search history.

(56) References Cited

U.S. PATENT DOCUMENTS

| | | | | | |
|---|---|---|---|---|---|
| 1,363,790 | A | * | 12/1920 | Hughes | 139/8 |
| 1,576,892 | A | * | 3/1926 | Austin | 139/9 |
| 1,709,572 | A | * | 4/1929 | Hathaway et al. | 139/8 |
| 1,814,294 | A | * | 7/1931 | Clark | 139/9 |
| 1,897,077 | A | * | 2/1933 | Shuttleworth | 139/9 |
| 1,909,113 | A | * | 5/1933 | Lowe | 139/2 |
| 1,931,092 | A | * | 10/1933 | Shuttleworth | 139/9 |
| 2,076,785 | A | * | 4/1937 | Knowland | 139/8 |
| 2,747,647 | A | * | 5/1956 | Brinton et al. | 156/435 |

(Continued)

FOREIGN PATENT DOCUMENTS

EP 1 156 146 A 11/2001

OTHER PUBLICATIONS

International Search Report dated Jul. 18, 2008.

*Primary Examiner* — Bobby Muromoto, Jr.
(74) *Attorney, Agent, or Firm* — Sughrue Mion, PLLC

(57) ABSTRACT

A yarn tuft transfer system for a carpet manufacturing machine, including one or more mounting devices secured to a belt or chain. Each mounting device includes a functional link element having a mounting for a payload, first securing device rotatably mounted on the functional link element about a first axis for securing the functional link element onto the belt or chain at a first position, and second for securing the functional link element onto the belt or chain at a second position spaced from the first, the device being rotatable relative to the functional link element about a second axis. The first securing device is moveable relative to the second securing device along a line perpendicular to and intersecting the first and second axes. The system further utilizing a yarn tuft holder mounted on each payload mounting.

20 Claims, 8 Drawing Sheets

U.S. PATENT DOCUMENTS 2,954,805 A * 10/1960 Wilkesman ..... 139/8
3,741,254 A * 6/1973 Clark ..... 139/2
3,807,459 A * 4/1974 Tolley ..... 139/7 D
3,937,157 A * 2/1976 Spanel et al. ..... 112/80.07
3,938,559 A * 2/1976 Dewhirst ..... 139/7 R
3,963,057 A * 6/1976 Dewhirst ..... 139/2
3,963,058 A * 6/1976 Dewhirst ..... 139/2
3,999,577 A * 12/1976 Dewhirst ..... 139/7 R
6,220,307 B1 * 4/2001 Griffith ..... 139/7 A
6,701,970 B2 * 3/2004 Burton ..... 139/7 A
6,935,257 B2 * 8/2005 Griffith ..... 112/80.73
6,935,381 B2 * 8/2005 Debuf et al. ..... 139/2
6,994,121 B2 * 2/2006 Burton ..... 139/7 A
7,044,172 B2 * 5/2006 Stewart ..... 139/7 A
8,083,875 B2 * 12/2011 Sheppard et al. ..... 156/72
2002/0134486 A1 * 9/2002 Brumbelow et al. ..... 156/79
2003/0145897 A1 * 8/2003 Burton ..... 139/37
2003/0150505 A1 * 8/2003 Burton ..... 139/7 A
2004/0079468 A1 * 4/2004 Reisdorf et al. ..... 156/72
2010/0200103 A1 * 8/2010 Burton ..... 139/8

* cited by examiner

YARN TUFT TRANSFER SYSTEM

FIELD OF THE INVENTION

The invention relates to a device for mounting a payload upon a belt or chain, particularly for a transfer system.

BACKGROUND TO THE INVENTION

Attachments to drive belts, particularly toothed drive belts, or chains are typically at only a single point and generally the exact position of the attachment is not critical for conveying or transport applications. Attachments may be made through protrusions extruded into or bonded to the back of the toothed belt or screwed or rivetted through the belt from the tooth side. In some examples the attachment is concealed within the tooth, such as disclosed in EP1092657A where a captive insert is buried in the tooth, or within the root of the tooth gap, such as disclosed in JP2005-075488A. In others it protrudes from the tooth side and requires modification of mating pulleys, to avoid the attachment, such as disclosed in JP2000-095316A. A disadvantage of a single attachment point is that it relies on belt tension to make it stable. Any loading on protruding attachments will tend to flex the belt easily.

DE102004032735A discloses a toothed belt having attachments each connected to the belt at two points. The stability of the attachment is improved over those having a single attachment point but the attachment points are too close to provide a precise position when the attachment is loaded.

EP1245510A discloses a device that attaches to a toothed belt at two points. Due to the width of the device, it is necessary that the device bends the belt so that can more easily ride around the cog rollers. However, in time, this will lead to localised stretching of the belt and inaccurate positioning.

A transfer system is required in which a payload is loaded onto an attachment of a belt, or the like, while positioned on a pulley. Existing systems will not provide sufficiently accurate and repeatable positioning. This is particularly evident where the loading involves exerting force on the transfer system to lock the payload onto it.

There is therefore a need in the art for an improved attachment for securing onto a belt or chain that is more stable when secured and can be used to provide accurate and repeatable positioning.

SUMMARY OF THE INVENTION

According to a first aspect of the invention there is provided a yarn tuft transfer system for a carpet manufacturing machine, comprising one or more mounting devices secured to a belt or chain, the or each mounting device including:

- a functional link element having a mounting for a payload;
- first securing means rotatably mounted on the functional link element about a first axis for securing the functional link element onto the belt or chain at a first position; and
- second securing means for securing the functional link element onto the belt or chain at a second position spaced from the first, said means being rotatable relative to the functional link element about a second axis;
- wherein the first securing means is moveable relative to the second securing means along a line perpendicular to and intersecting the first and second axes; and the system further comprising:
- a yarn tuft holder mounted on the or each payload mounting.

The yarn tuft holder may be similar to that described in applicant's co-pending UK patent application no. 0707800.9 filed on even date, entitled "Yarn Tuft Holder", or any other suitable yarn tuft holder.

According to a second aspect of the invention there is provided a carpet manufacturing machine comprising the yarn tuft transfer system of the first aspect.

According to a third aspect of the invention there is provided a method for making carpet using the carpet manufacturing machine of the second aspect, comprising the steps of:

- inserting yarn tufts into one of the yarn tuft holders at a first position;
- moving said yarn tuft holder to a second position;
- removing said yarn tufts from said yarn tuft holder; and
- securing the removed yarn tufts into a backing.

The machine may be a carpet weaving loom similar to that described in WO 95/31594 or WO 02/00978, or any other suitable carpet manufacturing machine.

Preferably, the device further comprises a control link element articulated with respect to the functional link element, the second securing means being rotatably mounted on the control link element about the second axis. The control link element acts to control the angle of the functional link element relative to the pulley radius. The articulation between the control link and the functional link permits displacement of the first and second securing means towards and away from one another in a constrained manner.

In a preferred embodiment, a plurality of the devices are attached to a toothed belt wound in tension around a set of pulleys. The devices are attached to the belt at two spaced apart attachment points. It utilises the accuracy of the belt pitch and well defined belt position while on the pulley to give an accurate and repeatable position and angle to the functional link, particularly while on the pulley.

The functional link is able to resist forces along the belt running direction. It is also able to resist forces perpendicular to the belt and resist moments about an axis parallel to the pulley rotational axis while on the pulley.

Resistance to moments may be greater than from the belt tension alone where the belt teeth are locked into a zero backlash pulley profile.

In a preferred embodiment, the securing means of the link elements includes a two part clamp arrangement that traps the belt. Preferably, one part of the clamp passes between teeth of the belt on the lower side of the belt.

Preferably, the links have different lengths. The functional link may be the longer link.

Preferably, the two belt attachment points are spaced by approximately the pulley radius apart (to the nearest tooth interval) to provide good resistance to moments on the functional link.

The lengths of the functional link and control link should be chosen to make the control link perpendicular to the functional link when the device is on the pulley. The functional link length should be as long as practical and the control link as short as practical. This arrangement gives the best angular stability and accuracy to the functional link.

Pulley teeth may be cut out at regular intervals, where necessary, to clear the securing means. The nominal number of teeth on the pulley should be a multiple of the tooth spacing between the two securing points of the device. In a preferred embodiment, there is provided a 30 teeth pulley and a 5 teeth securing point spacing such that 6 teeth are cut out.

In a preferred embodiment, the clamps pass over the upper and lower surfaces of the belt and hold the belt by a snug fit but without pressure. The clamp may include a bar that passes on the tooth side of the belt and may be shaped in any way to fit within the tooth form, and may extend further outside the tooth form. This may lead to a clearance between the clamp bar and the belt tooth flanks while the belt is between pulleys and a snug fit between the flanks while on each pulley.

Preferably, the axis of rotation of the securing means passes through or immediately adjacent one or more tension members embedded in the belt, such that they do not cause twisting in the tension members when the functional link is loaded.

The control link may comprise two separate links, one each side of the belt, but stability may be improved, if required, through making the two links as a single piece. In the case of the latter, cut out sections may be formed in the single piece control link for the functional link and the securing clamp of the control link.

Preferably, zero or low backlash joints are provided between the links and/or between the link(s) and their securing means.

BRIEF DESCRIPTION OF THE DRAWINGS

Examples of the present invention will now be described in detail with reference to the accompanying drawings, in which.

DETAILED DESCRIPTION

Figure 1:
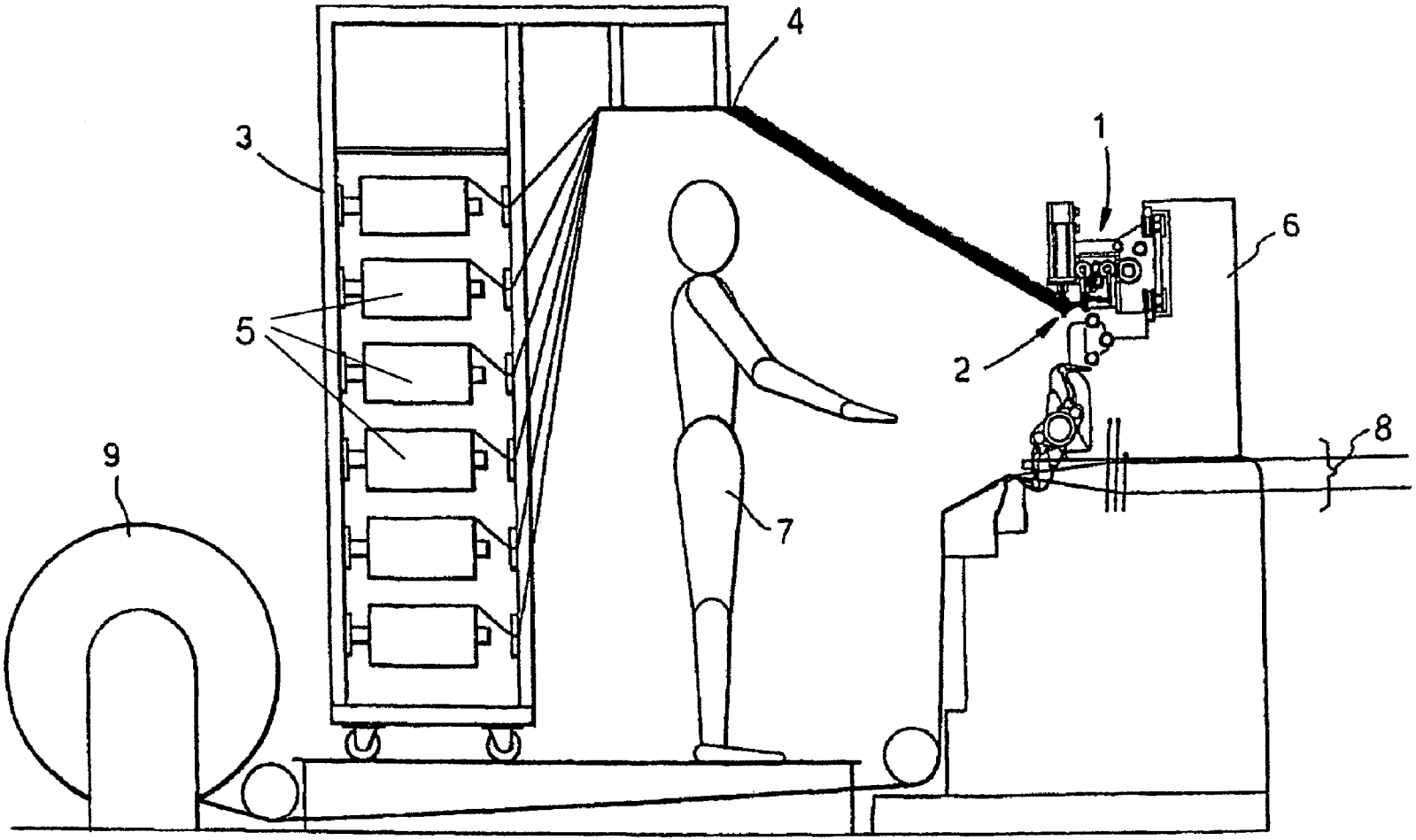
FIG. 1 is a partly sectioned side elevation of the loom.
Figure 2:
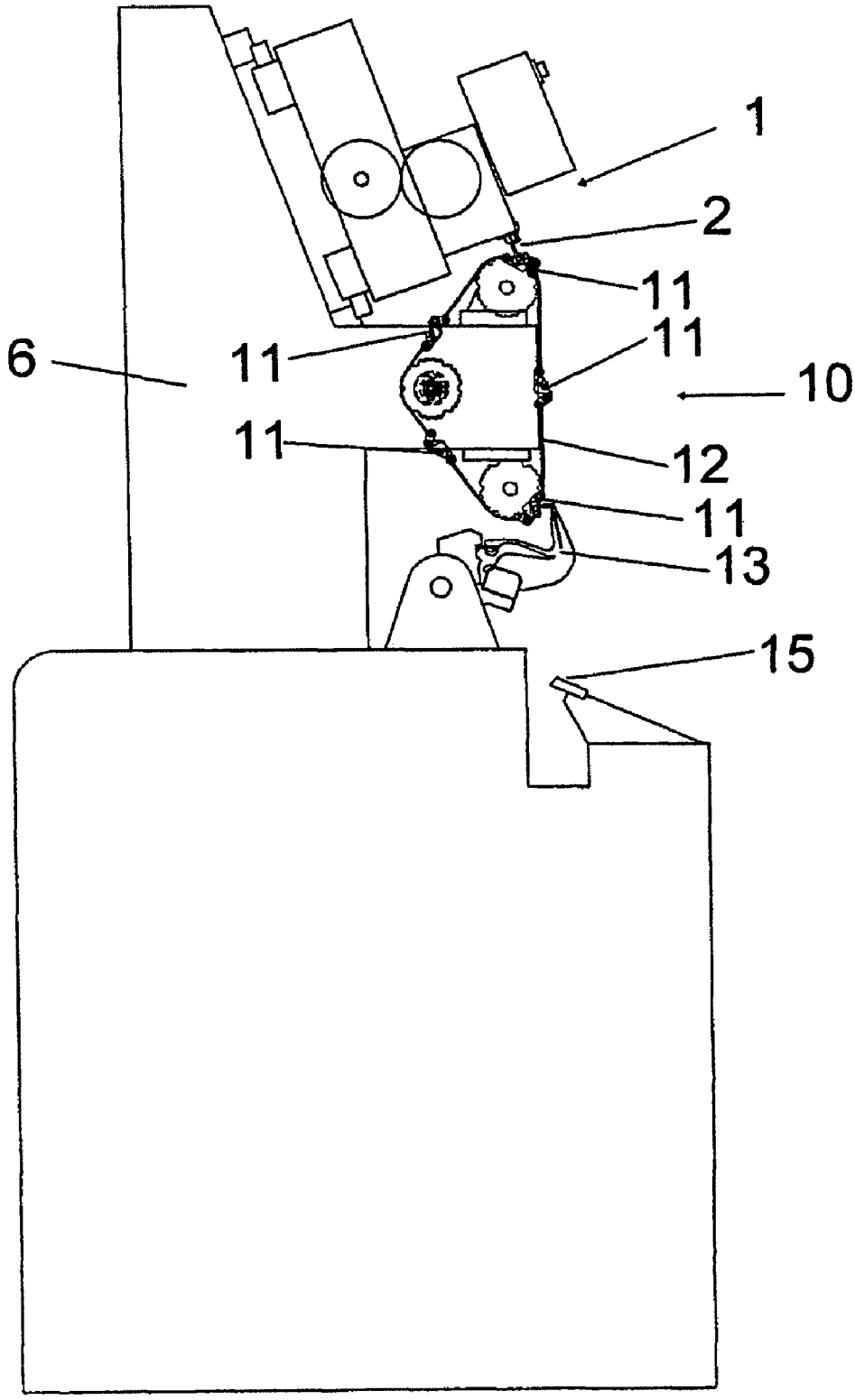
FIG. 2 is a schematic side elevation of the weaving section of the loom.

The carpet weaving loom of a preferred implementation of the invention is shown in FIGS. 1 and 2. The loom includes one or more tuft forming units 1 each of which supplies yarn tufts to one or more different weaving points and each of which includes a yarn inserting device 2, a movable creel 3 for holding supplies of yarn, and guides 4 to guide yarn from a supply 5 on the creel 3 to the or each tuft forming unit 1. The creel 3 is located in the front of the loom and behind the weavers position 7. This is on the opposite side of the loom from the warp beam (not shown) from which the warp threads 8 are provided. Alternatively, the creel 3 may be located above a remainder of the loom 6. The completed carpet is collected on a roll 9.

The loom includes a yarn tuft transfer system 10 including five yarn tuft holders 11 mounted on belts 12. The belts 12 are arranged for movement around a closed loop to sequentially present each of the yarn tuft holders 11 to the yarn tuft insertion devices 2. A set of grippers 13 are adapted to unload the lowermost yarn tuft holder 11 that is filled with tufts and transfer these to their respective weaving point 15.

In the preferred implementation shown with reference to FIGS. 1 and 2, as the tuft forming units 1 traverse across the loom, tufts are placed by the insertion devices 2 in tuft retention sites formed along the top edge of the yarn tuft holder 11. When all of the tuft retention sites have been loaded, the yarn tuft holder 11 rotates clockwise (as seen in FIG. 2) to move the loaded tuft holder 11 towards the lowermost position and to move an empty yarn tuft holder 11 towards the uppermost position. The insertion devices 2 of the tuft forming units 1 then load tufts into the uppermost yarn tuft holder as they traverse back across the loom in the opposite direction.

The grippers 13 move upwards, counter-clockwise as seen in FIG. 2, with their beaks open and then close to grip all of the tufts held by the lowermost yarn tuft holder 11. The grippers 13 then rotate in the opposite direction to move the tufts to the weaving point 15 where the tufts are woven into the carpet and the grippers 13 open to release the tufts. The beat up reeds and weft insertion mechanism have been omitted from FIG. 1 for clarity but are entirely conventional and similar to those used on the conventional gripper Axminster carpet looms.

Figure 3:
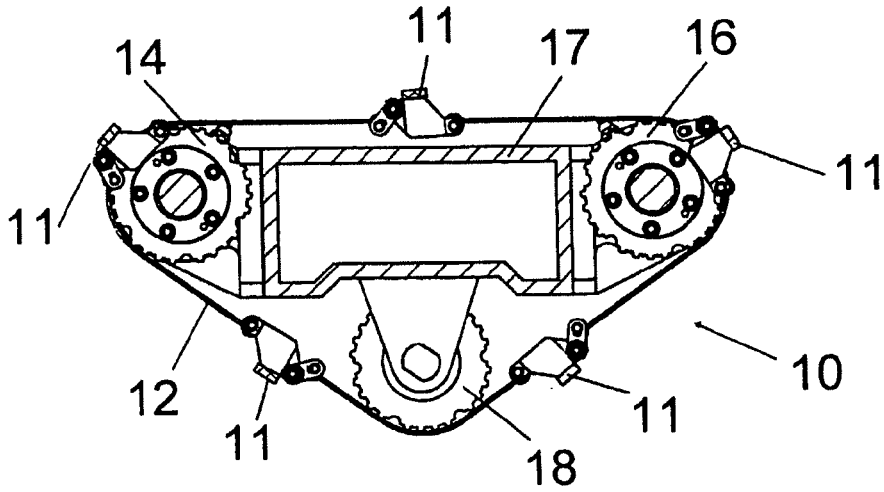
FIG. 3 is a side elevation of the yarn tuft transfer system of the loom.
Figure 4:
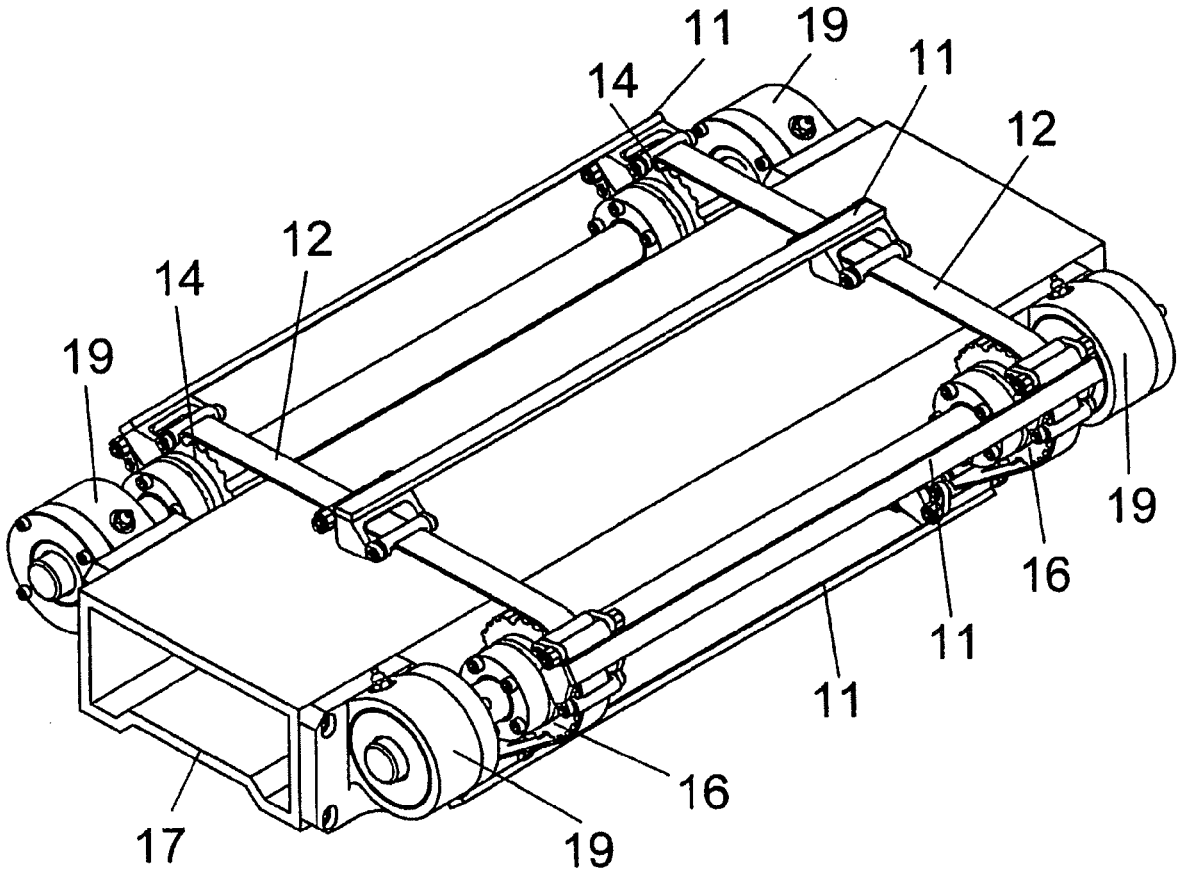
FIG. 4 is an isometric view of the yarn tuft transfer system of FIG. 3.

The yarn tuft transfer system 10 shown with reference to FIGS. 3 and 4 includes two sets of toothed pulleys 14,16,18 rotatably mounted on beam 17 via bearing blocks 19. Pulleys 14 are located on a common shaft and driven by a motor (not shown) at one end of the common shaft. The motor and shaft have a low backlash coupling and low backlash gearbox is disposed between the motor and the shaft. The gearbox provides sufficient accuracy in the positioning of the pulleys 14 and to allow the motor to resist movement of the pulleys 14,16 as forces are applied by the insertion device(s) 2 during loading of the yarn tufts and unloading by the loom grippers 13. It would also be possible to employ a brake system to lock the shaft through pulleys 14 in the correct position to prevent any movement from the loading/unloading if higher forces were to be applied. Wound around each set of pulleys 14,16,18 is a toothed belt 12. Teeth of the belts 12 engage with teeth of the pulleys 14,16,18. The five yarn tuft holders 11 are mounted upon the belts 12. The motor drives the belts 12 synchronously such that the yarn tuft holders 11 mounted on the belts 12 remain perpendicular to the belts 12. The motor may drive the belts 12 either continuously or in a stepped manner.

Of course, the arrangement of the yarn tuft transfer system 10 may be altered such that the number of yarn tuft holders 11, the number of pulleys 14,16,18, the number of motors, and the path of the belts 12 may be altered. For example, a greater or fewer number of yarn tuft holders 11 may be mounted on the belts 12; a greater or fewer number of the pulleys may be driven; and a greater or fewer number of pulleys may be provided.

Figure 5:
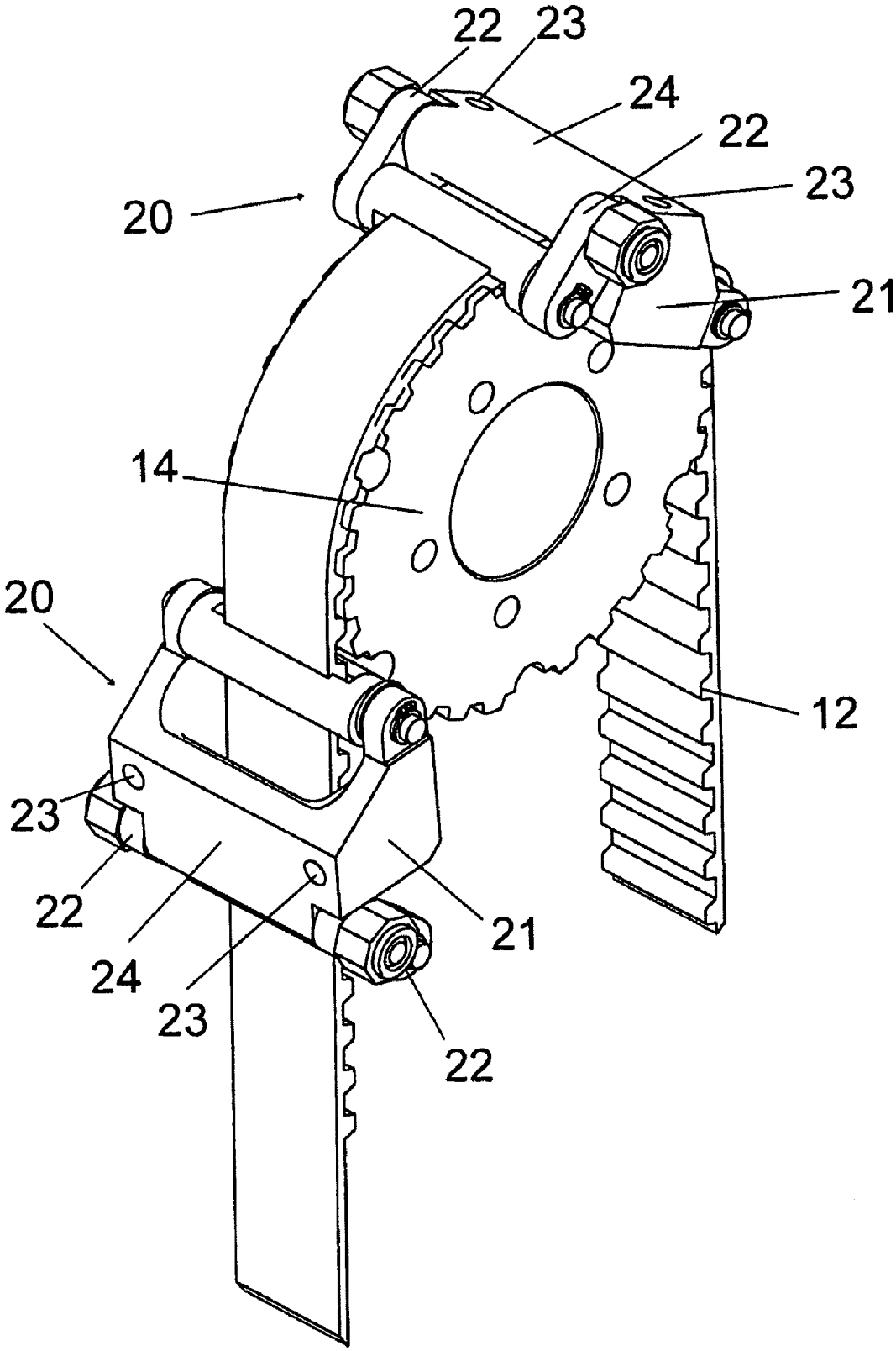
FIG. 5 is an isometric view of a part of the transfer system of FIG. 3.
Figure 6:
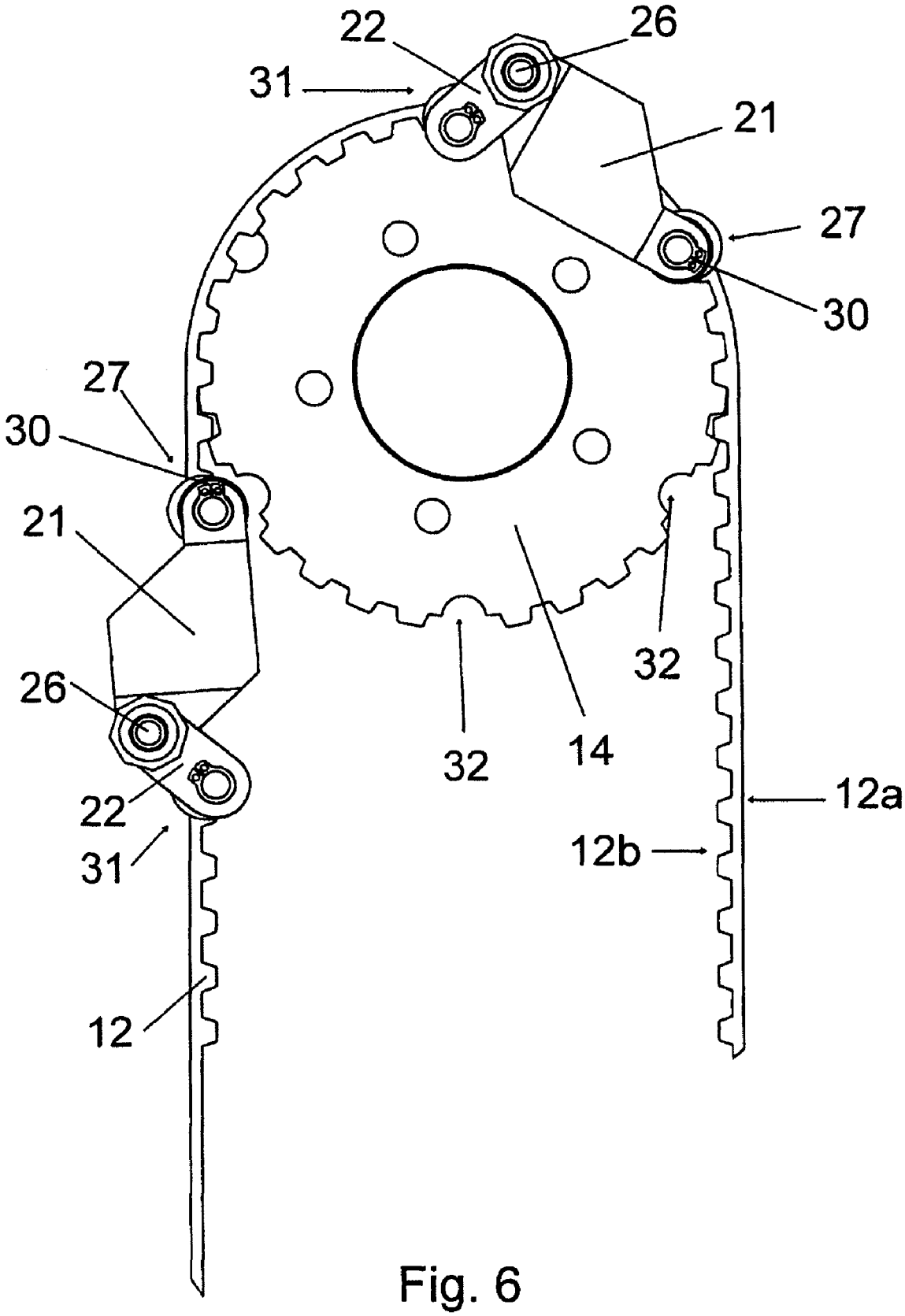
FIG. 6 is a side elevation of the part of the transfer system of FIG. 5.
Figure 7:
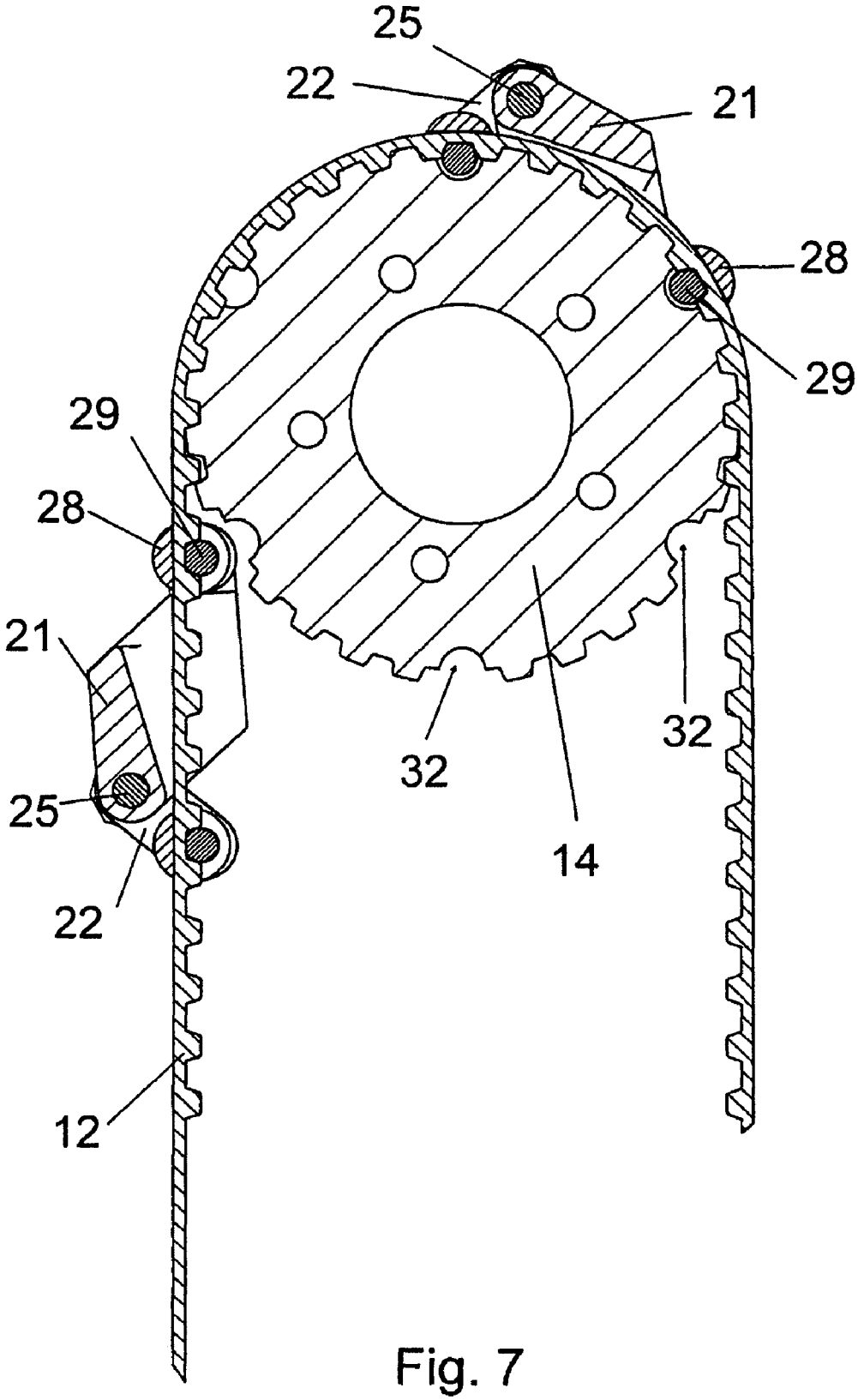
FIG. 7 is a sectioned side elevation taken through the centre-line of the transfer system of FIG. 5.

The mounting of each end of the yarn tuft holders 11 to the belts 12 will now be described with reference to a preferred embodiment shown in FIGS. 5-7. The mounting comprises an articulated linkage 20 including a functional link element 21 and a pair of control link elements 22. The functional link element 21 includes mounting holes 23 spaced on either side of a mounting platform 24 to which one end of a yarn tuft holder 11 may be mounted. The mounting may be by means of screws, for example, for ease of mounting and demounting of the yarn tuft holder 11. The control link elements 22 are articulated with respect to the functional link element 21 by means of a spindle 25 held in position by locking nuts 26. Of course, other means of articulation may be provided as will be apparent to those skilled in the art.

The functional link element includes a clamp 27 that passes over both upper 12*a* and lower 12*b* surfaces of the belt 12. The clamp 27 is rotatably mounted with respect to the functional link element 21 such that the functional link element can rotate with respect to the belt 12 as the belt passes around the pulleys. The clamp 27 includes a first bar 28 that passes over the upper surface 12*a* of the belt and a lower bar 29 that passes over the lower surface 12*b* of the belt. The upper bar 28 has a flat lower surface such that the upper bar 28 lies flush with the upper surface 12*a* of the belt as the belt 12 runs between the pulleys 14,16,18. The lower bar 29 has a form that just fits snugly within the tooth form of the lower surface 12*b* of the belt as the belt 12 encounters the pulleys 14,16. This generates a clearance between the lower bar 29 and the toothed profile of the lower surface 12*b* of the belt as the belt 12 runs between the pulleys.

The clamp 27 is fitted onto the belt 12 by positioning the upper bar 28 over the belt 12 and sliding the lower bar 29 through from one side of the upper bar 28 to its other side and then locking the lower bar 29 in position by clips 30 on each side of the clamp 27. The clips 30 prevent lateral movement between the upper and lower bars 28,29. The clamp 27 can similarly be removed from the belt 12 by releasing the clips 30, sliding out the lower bar 29 and removing the upper bar 28 from the belt 12.

The control link elements 22 are mounted to the belt 12 by a clamp 31 constructed in the same manner as the clamp 27.

The pulleys 14,16,18 have teeth cut out at regular intervals 32 such that the clamps 27,31 do not obstruct engagement between the pulley teeth and the belt teeth.

The articulated linkage 20 solves the problem in the prior art, and provides an accurate and repeatable position for a transfer system where the payload support is to be loaded whilst positioned on one of the pulleys. The articulated linkage 10 is therefore particularly suitable for the yarn tuft transfer system 20 of the invention.

The articulated linkage utilises the accuracy of the belt pitch and well defined belt position while on the pulley, due to the zero backlash pulley profile and accurate control of the motor, to give an accurate and repeatable position and angle to the functional link element 21, particularly whilst positioned on one of the pulleys. The functional link element 21 is able to resist forces in a direction along the belt 12. It also resists forces perpendicular to the belts 12 and resists moments about an axis parallel to the pulley rotational axis while on the pulley. Resistance to moments is greater than from the belts' tension alone, as the belt teeth are locked into a zero backlash pulley profile.

The functional link element 21 is longer than the control link elements 22. The control link elements 22 control the angle of the functional link element 21 with respect to the pulley radius. The clamps 27,31 are positioned such that the two belt attachment points for the articulated linkage 20 are spaced by approximately the pulley radius apart to provide good resistance to moments when a payload, such as the yarn tufts of the preferred embodiment, is loaded onto a payload support, such as the yarn tuft holder 11, mounted on the mounting platform 24 of the articulated linkage 20.

The lengths of the functional link element 21 and the control link elements 22 have been selected such that the control link elements 22 are substantially perpendicular to the functional link element 21 when the articulated linkage 20 is positioned on one of the pulleys. For improved angular stability and accurate positioning of the functional link element 21, the functional link element 21 is as long as practical and the control link elements 22 are as short as practical.

The cut out teeth at positions 32 on the pulleys for clearance of the clamps 27,31 dictate the nominal number of teeth on each pulley. The nominal number of teeth on each pulley must be a multiple of the tooth spacing between adjacent attachment positions 32. In the embodiment shown with reference to FIGS. 5-7, the transfer system has thirty teeth pulleys having a five teeth attachment point spacing such that there are six teeth cut out at locations 32.

Figure 8A:
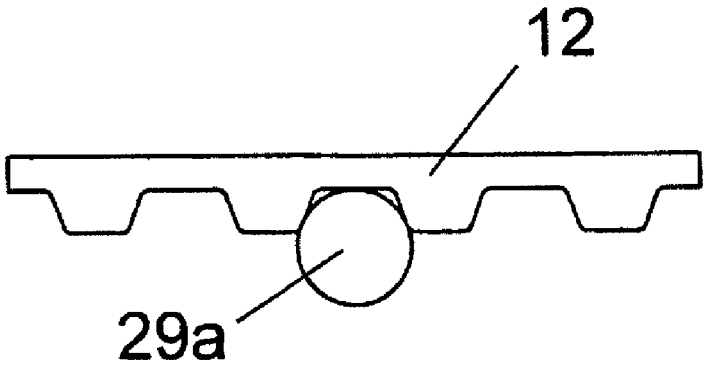
FIGS. 8*a* to 8*c* are schematic sectioned side elevations of alternative clamping arrangements.
Figure 8B:
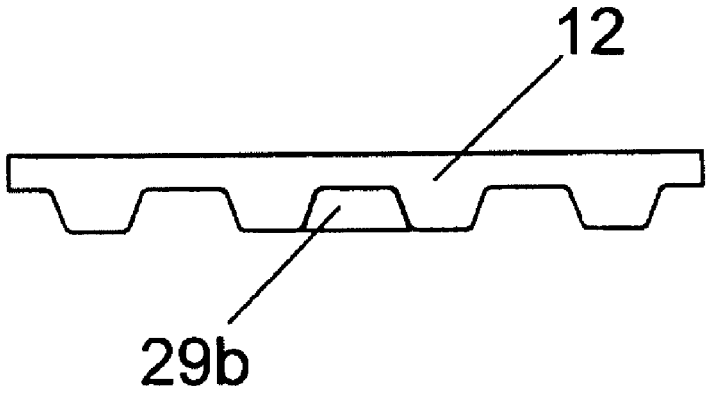
Figure 8C:
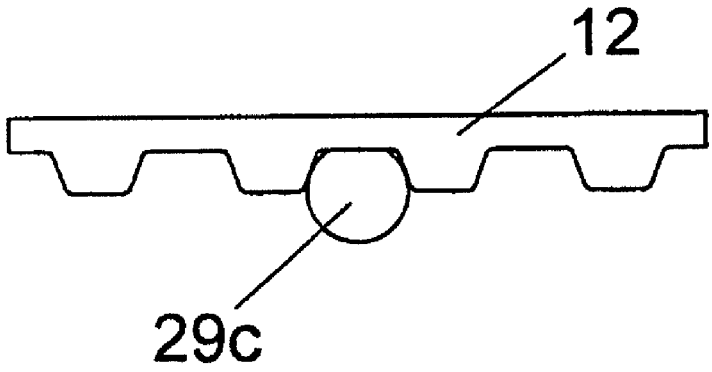

Alternative profiles of the lower bar 29 are contemplated within the scope of the invention and these are illustrated in FIGS. 8*a* to 8*c*. In the FIG. 8*a* embodiment, the lower clamp bar 29*a* is cylindrical. In the FIG. 8*b* embodiment, the lower clamp bar 29*b* has a trapezoidal cross-section that fits within the tooth profile of the belt 12 and does not extend beyond that profile. In the FIG. 8*c* embodiment the lower clamp bar 29*c* has a flattened cylindrical shape similar to the lower clamp bar 29 but leaving a slight clearance near the tooth route of the belt 12.

The lower clamp bar 29*a* leaves the greatest gap within the belt tooth profile and so requires larger cut outs in the pulleys leading to reduced support of adjacent teeth. However, the cylindrical shape of the bar 29*a* has low manufacturing costs and is strong. The bar 29*b* fits snugly within the belt tooth profile and so gives accurate positioning and high strength with good transfer of loads between the bar and the tooth flanks. The cut outs in the pulley also do not interfere with support of adjacent teeth. However, the bar 29*b* is expensive to manufacture and less rigid than other embodiments. The bar 29*c* is cheaper to manufacture and is stronger than the bar 29*b* and provides reasonable support of adjacent teeth.

Figure 9:
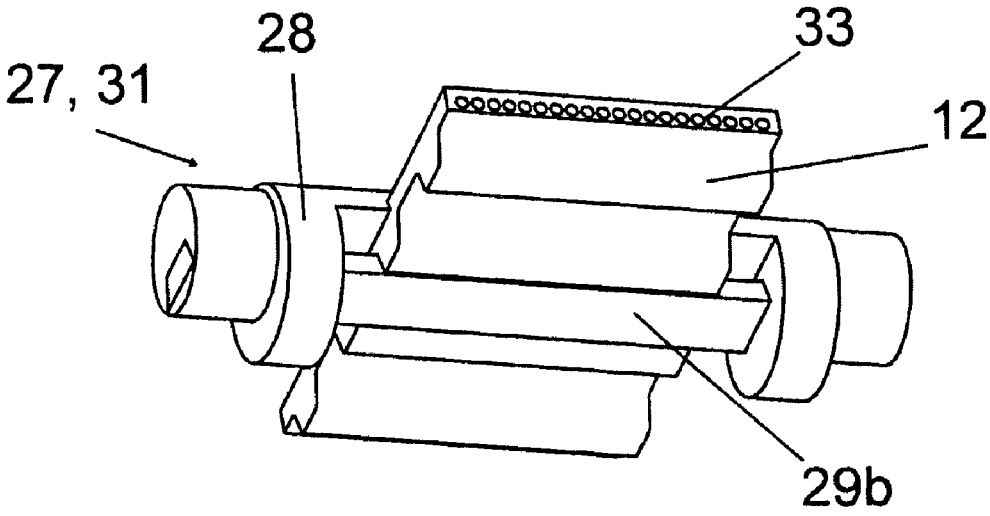
FIG. 9 is an isometric view of an alternative clamping arrangement.
Figure 10:
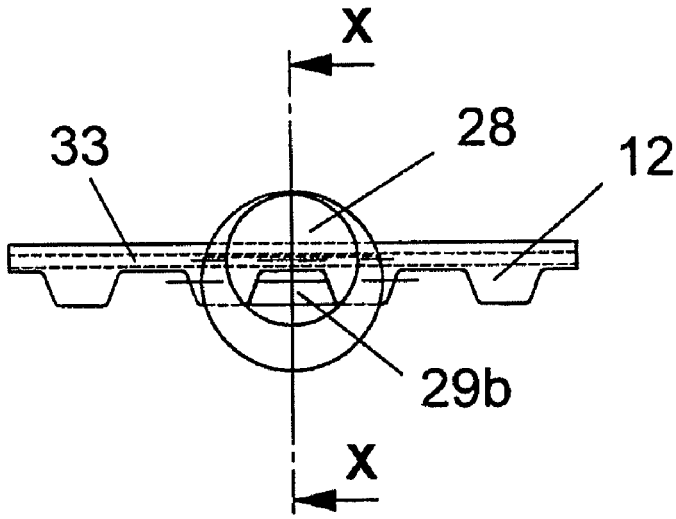
FIG. 10 is a side elevation of the clamping arrangement of FIG. 9.
Figure 11:
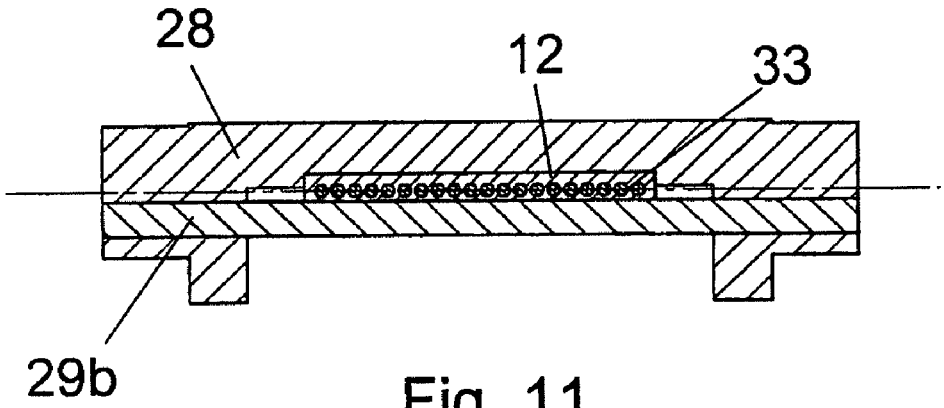
FIG. 11 is a sectioned view along line X-X of FIG. 10.

A clamp 27,31 constructed having the lower clamp bar 29*b* is shown in FIGS. 9-11. The belt 12 is shown having tension members 33 running longitudinally there through and these are also preferably provided in the embodiment shown with reference to FIGS. 5-7. The clamps 27,31 preferably have their axes of rotation intersecting the tension members 33 so that the clamps 27,31 do not cause twisting in the tension members 33 when the functional link element is loaded. In practice, the approximation of the rotation axis close to the tension members 33 has proved satisfactory and avoids larger bearing diameters and more complex attachment configurations.

In the embodiment described with reference to FIGS. 5-7, the control link elements 22 are illustrated as two separate link elements, one on each side of the belt 12. However, stability may be improved, if required, through manufacturing the control link elements as a single body having cutout sections for the functional link element 21 and the control link element clamp 31.

To minimise backlash and to improve the positional accuracy of the transfer system 10, zero backlash revolute joints are provided between the functional link element 21 and the control link element(s) 22 and between the functional link element 21 and the clamp 27 and the control link element(s) 22 and the clamp 31 in the preferred embodiments.

Whilst various clamps have been described in the foregoing it will be appreciated by those skilled in the art that other means for securing the functional link element 21 and the control link element(s) 22 to the belt 12 are envisaged within the scope of the invention. As described above, it is beneficial for the forces on the clamps to be aligned with or near to the belt tension members 33.

Whilst the invention has been described with reference to an articulated linkage having two attachment points to the belt 12, it is envisaged that articulated linkages having a greater number of attachment points also lie within the scope of the invention. The three or more attachment points would need to be equally spaced if the clamps of the above described system are to be employed. Otherwise, many teeth would need to be cut out from the pulleys. However, it will be appreciated by those skilled in the art that alternative securing means, such as bolts or mouldings, other than the above described clamps could be employed to overcome this restriction.

In a further alternative embodiment, the articulated linkage comprises a functional link element, similar to item 20 described above, having a mounting for a payload. The functional link element has a clamp at one end, similar to item 27 described above. However, at its other end a slot is provided. A second clamp, similar to item 31 described above, is freely rotatably mounted in the slot and is moveable within the slot in the slot direction. The functional link element is constrained from rotation by the second clamp. The slot length allows for the difference in length between the attachment points between chordal and circumferential lengths on the pulleys.

In yet further alternative embodiments, the articulated linkage may be secured onto a chain, rather than a belt. In one embodiment the chain is of a hollow roller type and attachment between the articulated linkage and the belt is provided by shafts passing through the hollow rollers. The belt clamps of the above described embodiments could be replaced by such shafts for mounting onto a chain as will be readily appreciated by those skilled in the art. The embodiments described above including one or more control link elements and those having a slot could be employed for attaching to a chain in this manner.

In the preferred embodiment, the transfer system is a yarn tuft transfer system and a yarn tuft holder 11 is mounted on the or each payload mounting 24. The yarn tuft holder 11 may take many different forms for securely holding each tuft. The tuft holder may be rigid and the profile of each slot defining a tuft retention site may be shaped such that the inherent elasticity of the tuft holds the tuft at the bottom of the slot when pressed therein. Alternatively, one or both opposing sides of each slot may be formed of a resilient material capable of gripping a tuft presented into the slot. Yet further, the sides of each slot may be rigid and a resilient clip may be provided to hold the tuft in place.

Preferably, the yarn tuft holder 11 is similar to that described in applicant's co-pending UK patent application no. 0707800.9 filed on even date, entitled "Yarn Tuft Holder". Such a yarn tuft holder comprises a resiliently deformable comb portion for receiving and holding yarn tufts, and a rigid comb portion disposed adjacent the resiliently deformable comb portion and for the guiding grippers 13 adapted to remove yarn tufts held by the resiliently deformable comb portion. This provides improved control over the yarn tufts and the grippers 13 leading to more reliable transfer of the yarn tufts to their weaving positions 15.

In the preferred yarn tuft holder the resiliently deformable comb portion is of plastics material and formed having an array of teeth separated by slots. The teeth are shaped so as to define a stem portion and a head portion wider than the stem portion. The length and form of the stem defines the degree of flexibility of each tooth; a shorter, fatter stem producing a stiffer tooth. The head portion has a cut out for forming a cavity with an adjacent tooth, the cavity being adapted for receiving and holding a yarn tuft at a yarn tuft retention site. A dimension of the cavity is suitable for firmly holding the yarn tuft and yet enabling removal of the yarn tuft by the grippers easily. A lip extends from the top of the cavity towards the adjacent tooth to help keep the tuft in position. The head portion is tapered towards the top so that the tooth does not undergo a large deflection as the yarn tuft is loaded and as the insertion device is retracted. This feature is particularly beneficial where the yarn tuft holder is implemented in a loom where the yarn tuft insertion device(s) continuously traverse across the length of the stationary yarn tuft holder loading tufts therein.

The invention claimed is:

1. A yarn tuft transfer system for a carpet manufacturing machine, comprising one or more mounting devices secured to a belt or chain, each mounting device including:

a functional link element having a mounting for a payload;

first securing means rotatably mounted on the functional link element about a first axis for securing the functional link element onto the belt or chain at a first position; and second securing means for securing the functional link element onto the belt or chain at a second position spaced from the first, said second securing means being rotatable relative to the functional link element about a second axis;

wherein the first securing means is moveable relative to the second securing means along a line perpendicular to and intersecting the first and second axes;

wherein the system further comprises:

a yarn tuft holder mounted on each payload mounting; and a control link element articulated with respect to the functional link element, wherein said second securing means is rotatably mounted on the control link element about said second axis, and wherein the control link element is formed of two link elements, one on each side of the belt or chain.

2. A yarn tuft transfer system according to claim 1, wherein the functional and control link elements have different lengths.

3. A yarn tuft transfer system according to claim 2, wherein the functional link element is longer than the control link element.

4. A yarn tuft transfer system according to claim 1, including zero or low backlash joints.

5. A yarn tuft transfer system according to claim 1, wherein the belt or chain is endless and wound around at least one pulley.

6. A yarn tuft transfer system according to claim 5, wherein the two securing positions of the or each mounting device are spaced by approximately the pulley radius.

7. A yarn tuft transfer system according to claim 5, wherein the functional and control link elements lie substantially perpendicular when positioned around the pulley.

8. A yarn tuft transfer system according to claim 1, wherein the belt is a toothed belt having teeth on its inner side.

9. A yarn transfer system according to claim 8, wherein the belt includes tension members embedded therein.

10. A yarn tuft transfer system according to claim 9, wherein the axes of rotation of the securing means passes through or immediately adjacent the tension members.

11. A yarn tuft transfer system according to claim 1, wherein the chain is a hollow roller type chain.

12. A yarn tuft transfer system according to claim 11, wherein the securing means of the functional and/or control link elements includes a shaft for passing through a hollow roller of the chain.

13. A yarn tuft transfer system according to claim 12, wherein the or each shaft passes through a respective hollow roller of the chain.

14. A carpet manufacturing machine comprising a yarn tuft transfer system according to claim 1.

15. A method for making carpet using a carpet manufacturing machine in accordance with claim 14, comprising the steps of:

inserting yarn tufts into one of the yarn tuft holders at a first position; moving said yarn tuft holder to a second position;

removing said yarn tufts from said yarn tuft holder; and securing the removed yarn tufts into a backing.

16. A yarn tuft transfer system for a carpet manufacturing machine, comprising one or more mounting devices secured to a belt or chain, each mounting device including:

a functional link element having a mounting for a payload;

first securing means rotatably mounted on the functional link element about a first axis for securing the functional link element onto the belt or chain at a first position; and second securing means for securing the functional link element onto the belt or chain at a second position spaced from the first, said second securing means being rotatable relative to the functional link element about a second axis; wherein the first securing means is moveable relative to the second securing means along a line perpendicular to and intersecting the first and second axes; wherein the system further comprises:

a yarn tuft holder mounted on each payload mounting: and a control link element articulated with respect to the functional link element, wherein said second securing means is rotatably mounted on the control link element about said second axis, and wherein the securing means of the functional and/or control link elements includes a clamp for passing over upper and lower surfaces of the belt.

17. A yarn tuft transfer system for a carpet manufacturing machine, comprising one or more mounting devices secured to a belt or chain, each mounting device including:

a functional link element having a mounting for a payload;

a first securing device rotatably mounted on the functional link element about a first axis which secures the functional link element onto the belt or chain at a first position; and a second securing device which secures the functional link element onto the belt or chain at a second position spaced from the first, said second securing device being rotatable relative to the functional link element about a second axis; wherein the first securing device is moveable relative to the second securing device along a line perpendicular to and intersecting the first and second axes; wherein the system further comprises:

a yarn tuft holder mounted on each payload mounting; and a control link element articulated with respect to the functional link element, wherein said second securing device is rotatably mounted on the control link element about said second axis, and wherein the control link element is formed of two link elements, one on each side of the belt or chain.

18. A yarn tuft transfer system according to claim 16, wherein the clamp includes a bar, the bar passing on the inner side of the belt and shaped so as to fit at least partially within the tooth form of the belt.

19. A yarn tuft transfer system according to claim 18, wherein the belt or chain is endless and wound around at least one pulley, and wherein the pulley has at least one recess for receiving a portion of the clamp bar that extends from within the tooth form of the belt.

20. A yarn tuft transfer system for a carpet manufacturing machine, comprising one or more mounting devices secured to a belt or chain, each mounting device including:

a functional link element having a mounting for a payload;

a first securing device rotatably mounted on the functional link element about a first axis which secures the functional link element onto the belt or chain at a first position; and a second securing device which secures the functional link element onto the belt or chain at a second position spaced from the first, said second securing device being rotatable relative to the functional link element about a second axis; wherein the first securing device is moveable relative to the second securing device along a line perpendicular to and intersecting the first and second axes;

wherein the system further comprises:

a yarn tuft holder mounted on each payload mounting: and a control link element articulated with respect to the functional link element, wherein said second securing device is rotatably mounted on the control link element about said second axis, and wherein the securing device of the functional and/or control link elements includes a clamp for passing over upper and lower surfaces of the belt.

* * * * *